US011330687B2

(12) United States Patent
Krattiger

(10) Patent No.: US 11,330,687 B2
(45) Date of Patent: May 10, 2022

(54) SYSTEM AND METHOD FOR INVALID PULSE REJECTION

(71) Applicant: ERP POWER, LLC, Moorpark, CA (US)

(72) Inventor: Steven C. Krattiger, Northridge, CA (US)

(73) Assignee: ERP POWER, LLC, Moorpark, CA (US)

( * ) Notice: Subject to any disclaimer, the term of this patent is extended or adjusted under 35 U.S.C. 154(b) by 124 days.

(21) Appl. No.: 16/905,461

(22) Filed: Jun. 18, 2020

(65) Prior Publication Data

US 2020/0413511 A1 Dec. 31, 2020

Related U.S. Application Data

(60) Provisional application No. 62/866,371, filed on Jun. 25, 2019.

(51) Int. Cl.
*H05B 45/325* (2020.01)
*H05B 45/10* (2020.01)

(52) U.S. Cl.
CPC ..... *H05B 45/325* (2020.01); *H05B 45/10* (2020.01)

(58) Field of Classification Search
CPC ..... H05B 45/10; H05B 45/325
See application file for complete search history.

(56) References Cited

U.S. PATENT DOCUMENTS

2007/0222739 A1* 9/2007 Yu ..... H05B 45/382 345/102
2012/0019160 A1* 1/2012 Lee ..... H05B 45/10 315/291
2012/0074860 A1* 3/2012 Lee ..... H05B 45/3725 315/240
2014/0340000 A1* 11/2014 Zhang ..... H05B 45/38 315/307
2021/0084726 A1* 3/2021 Averyt ..... H05B 47/18

* cited by examiner

*Primary Examiner* — Raymond R Chai
(74) *Attorney, Agent, or Firm* — Lewis Roca Rothgerber Christie LLP

(57) ABSTRACT

A method of controlling a power supply electrically coupled to a dimmer includes receiving a current pulse-width-modulated (PWM) pulse of a plurality of PWM pulses corresponding to a dimmer level, calculating a current duty cycle of the current PWM pulse, comparing the current duty cycle with a window of validity to determine whether the current duty cycle is within the window of validity, and in response to determining that the current duty cycle is not within the window of validity, determining whether a count of out-of-range PWM pulses having duty cycles not within the window of validity is greater than a threshold, and in response to determining that the count of out-of-range PWM pulses is greater than the threshold generating a sample value corresponding to the current duty cycle for transmission to the power supply.

20 Claims, 6 Drawing Sheets

SYSTEM AND METHOD FOR INVALID PULSE REJECTION

CROSS-REFERENCE TO RELATED APPLICATION(S)

This application claims priority to, and the benefit of, U.S. Provisional Application No. 62/866,371 ("MISSING PULSE CORRECTION FOR PROGRAMMABLE TRIAC CONTROL DRIVERS"), filed on Jun. 25, 2019, the entire content of which is incorporated herein by reference.

The present application is also related to U.S. patent application Ser. No. 16/905,421, entitled "MULTI-INPUT POWER SUPPLY SYSTEM AND METHOD OF USING THE SAME", filed on Jun. 18,2020, which claims priority to and the benefit of U.S. Provisional Application No. 62/867,052 ("TRIAC DETECTION SOFTWARE"), filed on Jun. 26, 2019, the entire contents of which are incorporated herein by reference.

The present application is also related to U.S. patent application Ser. No. 16/905,407, entitled "HIGH PERFORMANCE DIMMING BASED ON DIMMER SLEW-RATE" , filed on Jun. 18, 2020, which claims priority to and the benefit of U.S. Provisional Application No. 62/867,027 ("HIGH PERFORMANCE DIMMING BASED ON DIMMER SLEW-RATE"), filed on Jun. 26, 2019, the entire contents of which are incorporated herein by reference.

The present application is also related to U.S. patent application Ser. No. 16/905,501, entitled "SYSTEM AND METHOD FOR MULTI-SLOPE CONTROL OF LIGHTING INTENSITY", filed on Jun. 18, 2020, which claims priority to and the benefit of U.S. Provisional Application No. 62/867,056 ("MULTI-SLOPE TRIAC CONTROL OF LIGHTING INTENSITY"), filed on Jun. 26, 2019, the entire contents of which are incorporated herein by reference.

The present application is also related to U.S. patent application Ser. No. 16/905,438, entitled "DYNAMIC FILTERING FOR SMOOTH DIMMING OF LIGHTS" , filed on Jun. 18, 2020, which claims priority to and the benefit of U.S. Provisional Application No. 62/866,392 ("UTILIZING DYNAMIC FILTERING FOR SMOOTH DIMMING OF LIGHTS"), filed on Jun. 25, 2019, the entire contents of which are incorporated herein by reference.

The present application is also related to U.S. patent application Ser. No. 16/905,516, entitled "MOVEMENT-BASED DYNAMIC FILTERING FOR SMOOTH DIMMING OF LIGHTS", filed on Jun. 18, 2020, which claims priority to and the benefit of U.S. Provisional Application No. 62/866,392 ("UTILIZING DYNAMIC FILTERING FOR SMOOTH DIMMING OF LIGHTS"), filed on Jun. 25, 2019, the entire contents of which are incorporated herein by reference.

FIELD

Aspects of the present invention are related to a system for noise and distortion rejection and a method for using the same.

BACKGROUND

Dimmable lighting has been around for decades, and one the most common methods of dimming is through the use of Phase-Cut Triac dimmers. These dimmers generally chop off a portion of the incoming AC waveform to reduce the overall power received at the light, thus dimming it.

While this type of dimming works well for incandescent, fluorescent, and halogen lights, there is difficulty in using such dimmers with LED lights. Triac dimmers do not all behave the same, and some miss pulses and/or produce distorted pulses, especially at power-up, or in very low dimmed positions. Such operation may not affect other forms of lighting, however even a single missed or distorted pulse can be perceived as an unacceptable flicker when used with LED lighting.

The above information disclosed in this Background section is only for enhancement of understanding of the disclosure, and therefore it may contain information that does not form the prior art that is already known to a person of ordinary skill in the art.

SUMMARY

Aspects of embodiments of the present invention are directed to a power supply system for providing smooth and stable power outputs.

Aspects of embodiments of the present disclosure are directed to power supply controller configured to accept an incoming stream of pulse width modulated (PWM) pulses from any type of Triac dimmer and reject noise therein and correct for distorted and missing pulses, which may result in a clean power-supply output suitable for flicker-free LED lighting.

According to some embodiments of the present disclosure, there is provided a method of controlling a power supply electrically coupled to a dimmer, the method including: receiving a current pulse-width-modulated (PWM) pulse of a plurality of PWM pulses corresponding to a dimmer level; calculating a current duty cycle of the current PWM pulse; comparing the current duty cycle with a window of validity to determine whether the current duty cycle is within the window of validity; and in response to determining that the current duty cycle is not within the window of validity, determining whether a count of out-of-range PWM pulses having duty cycles not within the window of validity is greater than a threshold; and in response to determining that the count of out-of-range PWM pulses is greater than the threshold: generating a sample value corresponding to the current duty cycle for transmission to the power supply.

In some embodiments, the method further includes: receiving a modified AC input signal from the dimmer; and generating a PWM signal based on the modified AC input signal, the PWM signal including the plurality of PWM pulses.

In some embodiments, the current duty cycle of the current PWM pulse corresponds to a current dimmer level of the dimmer.

In some embodiments, the window of validity corresponds to a previous duty cycle associated with a previous PWM pulses of the plurality of PWM pulses.

In some embodiments, the window of validity includes values within a range of the previous duty cycle.

In some embodiments, the range of the previous duty cycle is from a negative tolerance to a positive tolerance of the previous duty cycle.

In some embodiments, the method further includes, in response to determining that the current duty cycle is not within the window of validity: incrementing the count of out-of-range PWM pulses.

In some embodiments, the method further includes: in response to determining that the current duty cycle is within the window of validity, generating the sample value corresponding to the current duty cycle for transmission to the power supply.

In some embodiments, the method further includes, in response to determining that the count of out-of-range PWM pulses is greater than the threshold: updating the window of validity based on the current duty cycle; and generating the sample value corresponding to the current duty cycle for transmission to the power supply.

In some embodiments, the method further includes: in response to determining that the count of out-of-range PWM pulses is less than or equal to the threshold: identifying the current PWM pulse as invalid to discard the current PWM pulse.

In some embodiments, the comparing the current duty cycle with the window of validity includes: determining that the current duty cycle is less than a minimum duty cycle in the window of validity, and wherein the method further includes, in response to determining that the current duty cycle is not within the window of validity: incrementing a lower count of out-of-range PWM pulses having duty cycles not within the window of validity; and setting the count of out-of-range PWM pulses as the lower count of out-of-range PWM pulses.

In some embodiments, the comparing the current duty cycle with the window of validity includes: determining that the current duty cycle is greater than a maximum duty cycle in the window of validity, and wherein the method further includes, in response to determining that the current duty cycle is not within the window of validity: incrementing a higher count of out-of-range PWM pulses having duty cycles not within the window of validity; and setting the count of out-of-range PWM pulses as the higher count of out-of-range PWM pulses.

In some embodiments, the threshold is from a value from 3 to 10.

In some embodiments, the method further includes generating a control signal based on a plurality of sample values including the sample value for transmission to the power supply.

According to some embodiments of the present disclosure, there is provided a power supply controller coupled to a power supply, the power supply controller including: a processor; and a processor memory local to the processor, wherein the processor memory has stored thereon instructions that, when executed by the processor, cause the processor to perform: receiving a current pulse-width-modulated (PWM) pulse of a plurality of PWM pulses corresponding to a dimmer level; calculating a current duty cycle of the current PWM pulse; comparing the current duty cycle with a window of validity to determine whether the current duty cycle is within the window of validity; and in response to determining that the current duty cycle is not within the window of validity, determining whether a count of out-of-range PWM pulses having duty cycles not within the window of validity is greater than a threshold; and in response to determining that the count of out-of-range PWM pulses is greater than the threshold: generating a sample value corresponding to the current duty cycle for transmission to the power supply.

In some embodiments, the instructions, when executed by the processor, further cause the processor to perform, in response to determining that the count of out-of-range PWM pulses is greater than the threshold: updating the window of validity based on the current duty cycle; and generating the sample value corresponding to the current duty cycle for transmission to the power supply.

According to some embodiments of the present disclosure, there is provided a power supply system coupled to a dimmer and a light source, the power supply system including: a pulse-width-modulated (PWM) converter configured to receive a modified AC input signal from the dimmer, and to generate a PWM signal based on the modified AC input signal, the PWM signal including a plurality of PWM pulses; and a power supply controller is configured to perform: receiving a current PWM pulse of the plurality of PWM pulses corresponding to a dimmer level; calculating a current duty cycle of the current PWM pulse; comparing the current duty cycle with a window of validity to determine whether the current duty cycle is within the window of validity; and in response to determining that the current duty cycle is not within the window of validity, determining whether a count of out-of-range PWM pulses having duty cycles not within the window of validity is greater than a threshold; and in response to determining that the count of out-of-range PWM pulses is greater than the threshold: generating a sample value corresponding to the current duty cycle.

In some embodiments, the power supply controller is further configured to generate a control signal based on a plurality of sample values including the sample value.

In some embodiments, the power supply system further includes: a power supply configured to drive the light source based on the control signal In some embodiments, the current duty cycle of the current PWM pulse corresponds to a current dimmer level of the dimmer.

BRIEF DESCRIPTION OF THE DRAWINGS

The accompanying drawings, together with the specification, illustrate example embodiments of the present disclosure, and, together with the description, serve to explain the principles of the present disclosure.

DETAILED DESCRIPTION

The detailed description set forth below is intended as a description of example embodiments of a power supply system for lighting systems and a method of operation of the same, provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the spirit and scope of the disclosure. As denoted elsewhere herein, like element numbers are intended to indicate like elements or features.

Figure 1:
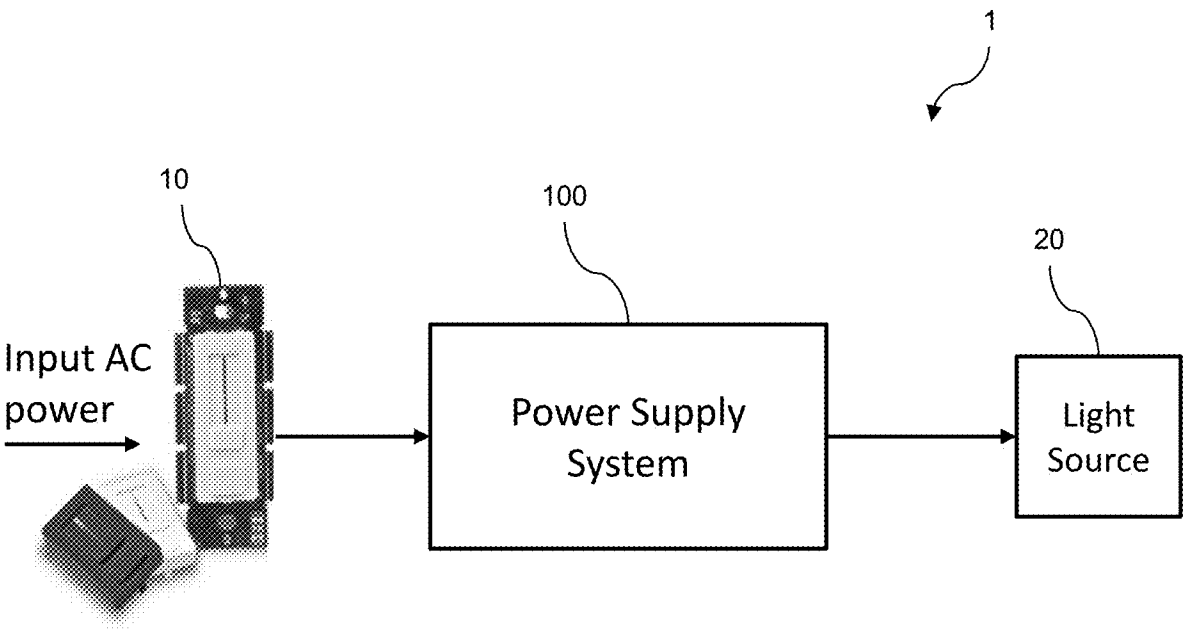
FIG. 1 is a block diagram of a lighting system utilizing a power supply system with input distortion rejection, according to some embodiments of the present disclosure.

FIG. 1 is a block diagram of a lighting system 1 utilizing a power supply system 100 with input distortion rejection, according to some embodiments of the present disclosure.

The lighting system 1 includes a dimmer (e.g., a phase dimmer) 10, the power supply system 100, and a light source 20. According to some examples, the dimmer interface may be a rocker interface, a tap interface, a slide interface, a rotary interface, or the like. A user may adjust the dimmer level by, for example, adjusting a position of a dimmer lever or a rotation of a rotary dimmer knob, or the like. The dimmer 10 receives an AC input signal (e.g., a 120 V AC signal from the wall) and modifies (e.g., cuts/chops a portion of) the AC input voltage sinewave signal according to the dimmer level before sending it to the power supply system 100, and thus variably reduces the electrical power delivered to the power supply system 100. The power supply system 100 in turn produces a drive signal (e.g., an output current or voltage) that is proportional to the reduced power provided by the dimmer 10 and provides the drive signal to the light source 20. Thus, the light output of the light source 20 may be proportional to the phase angle of the modified sine wave. This results in the dimming of the light output. In some examples, the dimmer 10 may be a TRIAC or ELV dimmer, and may chop the front end or leading edge of the AC input signal. The light source 20 may include one or more light-emitting-diodes (LEDs). In some embodiments, the power supply system 100 also detects and corrects for glitches in modified AC input signal received from the dimmer 10 to reduce or eliminate flicker in the light output of the light source 20.

Figure 2:
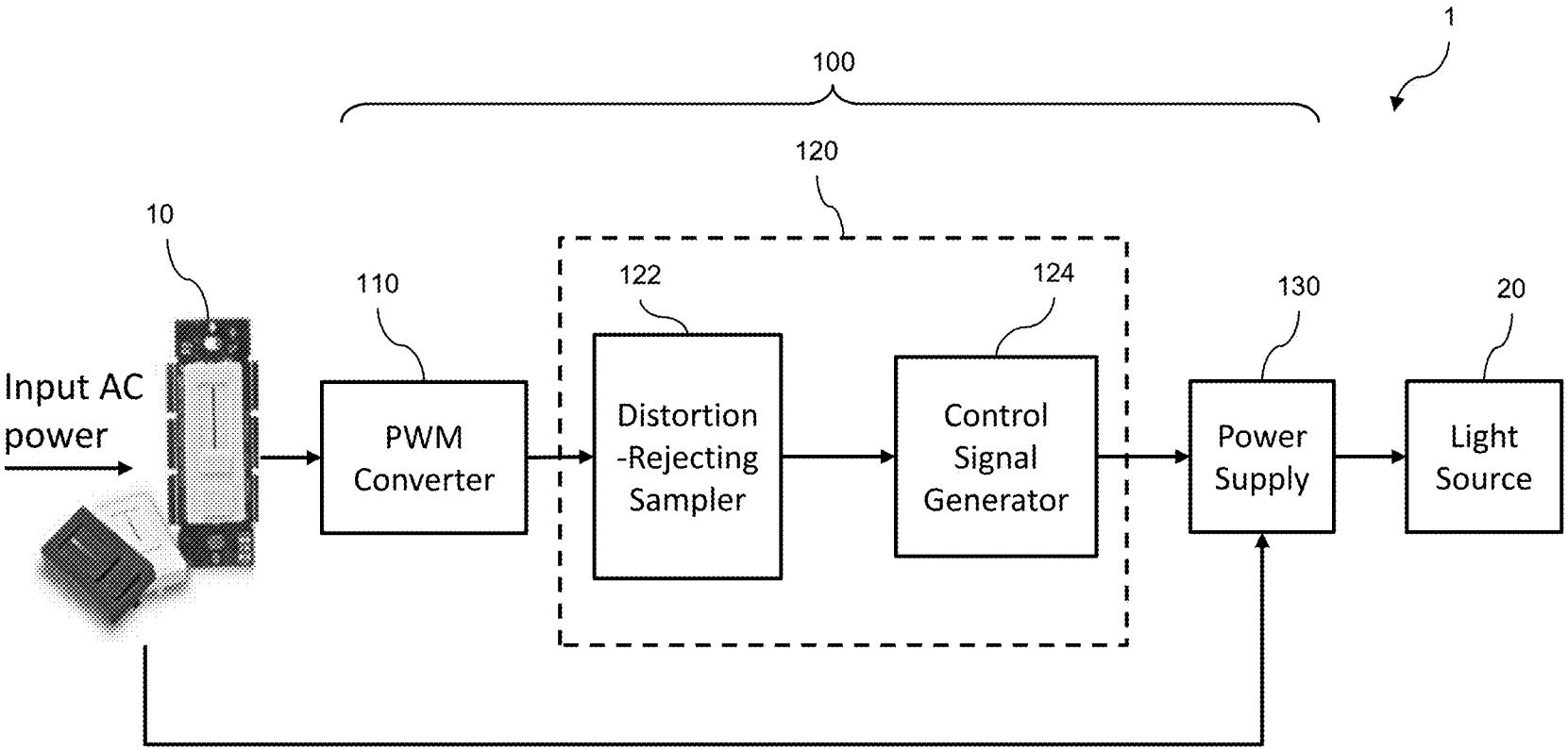
FIG. 2 is block diagram of the power supply system with distortion rejection within the lighting system, according to some embodiments of the present disclosure.
Figure 3:
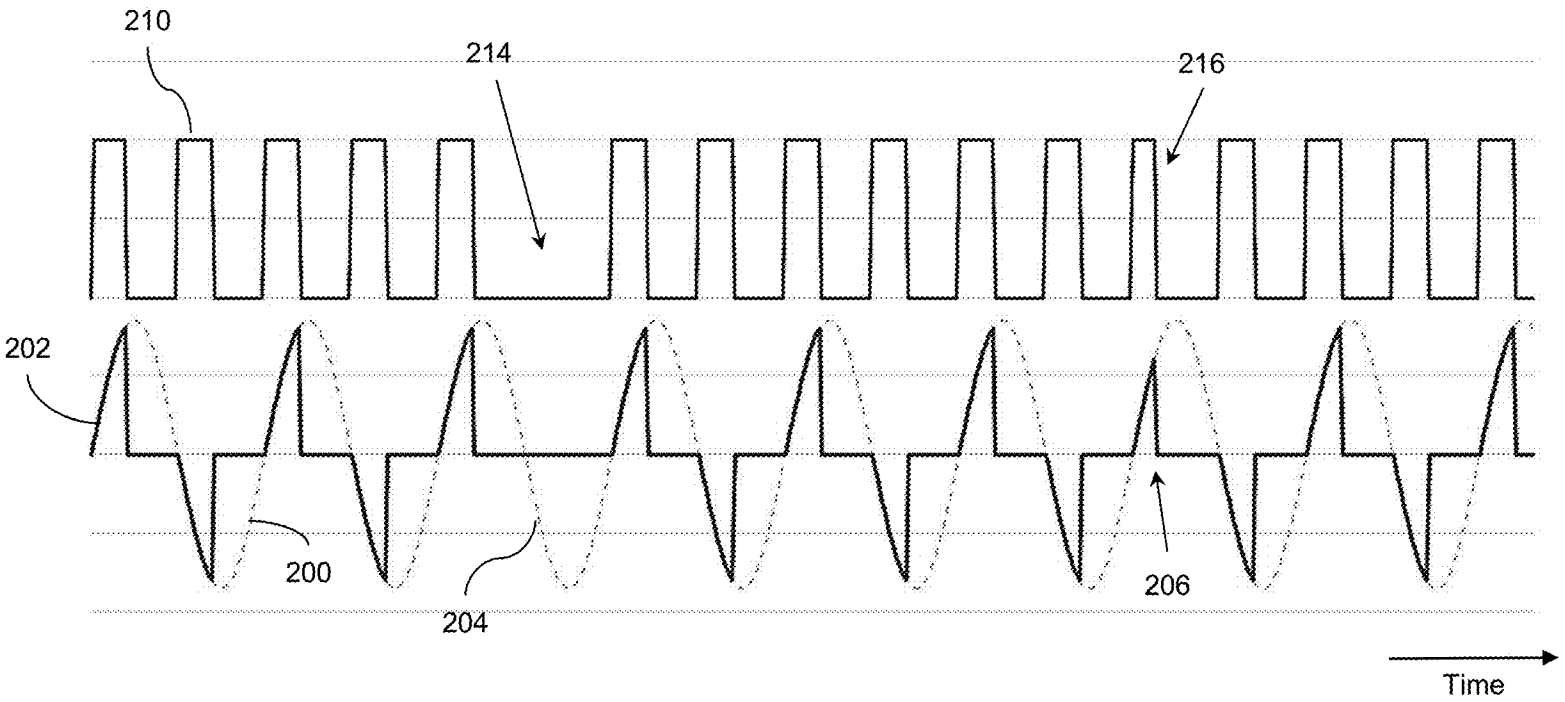
FIG. 3 illustrates the phase-cut waveform of a modified AC input signal having distortions and the resulting PWM signal, according to some examples.
Figure 4:
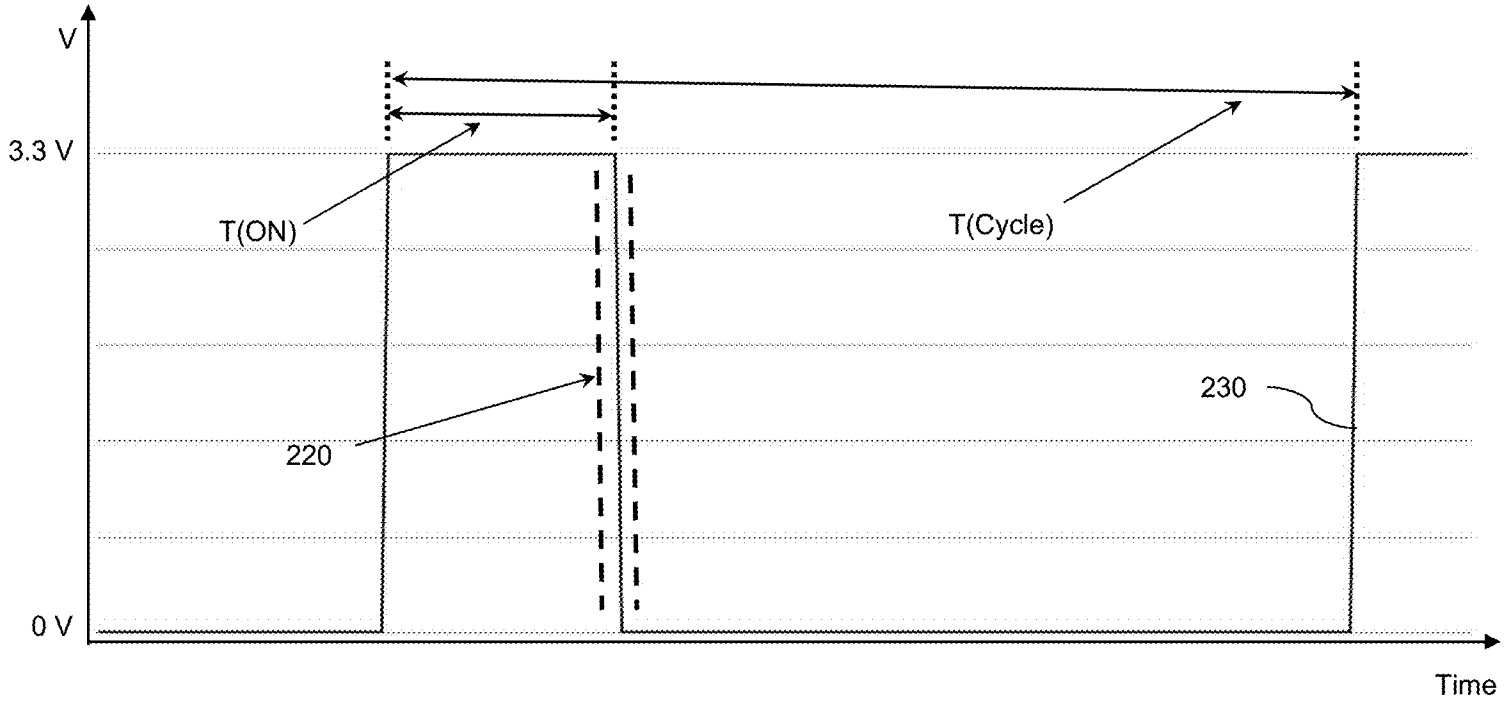
FIG. 4 illustrates a window of validity for a PWM pulse of the PWM signal, according to some embodiments of the present disclosure.

FIG. 2 is block diagram of the power supply system 100 with distortion rejection within the lighting system 1, according to some embodiments of the present disclosure. FIG. 3 illustrates the phase-cut waveform of a modified AC input signal having distortions, and the resulting PWM signal, according to some examples. FIG. 4 illustrates a window of validity for a PWM pulse of the PWM signal, according to some embodiments of the present disclosure.

Referring to FIGS. 2-3, the power supply system 100 includes a PWM converter 110, a power supply controller 120, and a power supply 130.

The PWM converter 110 is configured to convert the modified AC input signal received from the dimmer 10 into a pulse width modulation (PWM) signal for processing by the power supply controller 120. The PWM converter 110 may include one or more comparators that compare the positive and negative swings of the incoming modified AC input signal with one or more set or predefined thresholds to generate a corresponding PWM signal. Thus, the PWM converter 110 maps the dimmed power of the modified AC input signal to pulse width modulations of the PWM signal. In some examples, the duty cycle of the PWM signal represents the dimmer level (i.e., the user setting at the dimmer 10). In some examples, a high value in the PWM signal may be about 3.3 V, which may correspond to a logic high (or a binary '1'), and a low value may be about 0 V, which may correspond to a logic low (or binary '0).

In some embodiments, the power supply controller 120 is configured to measure (e.g., continuously measure) the duty cycle of the PWM signal and to generate a sequence of sample values, which may correspond to the dimming levels of the dimmer 10 at a plurality of sample times. The power supply controller 120 then generates a control signal based on the sample values, which it provides to the power supply 130.

The power supply 130 in turn generates a drive signal based on the control signal for powering and controlling the brightness of the light source 20. The drive signal may depend on the type of the one or more LEDs of the light source 20. For example, when the one or more LEDs of the light source 20 are constant current LEDs the drive signal may be a variable voltage signal, and when the light source 20 requires constant voltage, the drive signal may be a variable current signal. The power supply 130 may receive its input power from the modified AC signal from the dimmer 10.

According to some embodiments, the power supply controller 120 includes a sampler (e.g., a distortion-rejecting sampler) 122 and control signal generator 124. The sampler 122 measures the duty cycle of each PWM pulse of the received the PWM signal to determine the dimmer level of the dimmer 10 at regular intervals, and generates a plurality of sample values corresponding to the duty cycle of the PWM pulses. Each sample value may a value between 0, which may indicate a 0% duty cycle for a corresponding PWM pulse, and a maximum value, which may indicate a 100% duty cycle for the corresponding PWM pulse. As such, a value of zero may correspond to a minimum brightness setting (e.g., 0% brightness setting) at the dimmer 10, which may indicate, e.g., a user's desire to turn the light source 20 completely off. Further, the maximum value (e.g., 1000 or 10000) may correspond to a maximum brightness setting (e.g., 100% brightness setting) at the dimmer 10, which may indicate, e.g., a user's desire to turn the light source 20 fully on. In other words, each sample value corresponds to a new target setting that a light source 20 should output. The sampling frequency of the sampler 122 may be significantly faster than the speed at which a user can change the dimmer level. For example, the sampling frequency may be about 12 kHz or higher.

The control signal generator 124 then generates a control signal (e.g., a PWM signal) based on the plurality of sample values. In some examples, the control signal generator 124 maps the sample values to duty cycles of a PWM pulse, which is referred to as the control signal. In some examples, the control signal is filtered to produce a smooth PWM analog signal that can be used by the power supply to control the light intensity of the light source 20. However, embodiments of the present disclosure are not limited to PWM control signals, and any suitable modulation scheme may be utilized to control the power supply 130, so long as the power supply 130 is properly designed for such a modulation scheme. Thus, in some examples, the control signal may be a pulse amplitude modulation signal, a pulse frequency modulation signal, or a variable DC signal (e.g., a DC voltage ranging from 0 V to 10 V).

As shown in FIG. 3, when the dimmer 10 generates the modified AC input signal (e.g., 202) from the wall AC signal (e.g., 200), various unexpected and undesirable glitches may randomly appear in the phase-cut input waveform. For example, a missing pulse (e.g., 204) in the modified input signal may result in a missing PWM pulse (e.g., 214) in the PWM signal (e.g., 210). Further, a distorted pulse (e.g., 206) in the modified input signal may result in a PWM pulse (e.g., 216) having a distorted duty cycle. If not corrected, the glitches in the PWM signal may cause incorrect sample values to be generated, which will in turn affect the control signal and the driving signal, thus causing flickers in the output of the light source 20. Even when the sample values are filtered, some distortions (e.g., from missing pulses) make it to the output of the filter and result in noticeable flickers in the light output. Therefore, standard filtering may be ineffective.

Thus, the power supply controller 120, according to some embodiments, monitors the duty cycle of each pulse of the PWM signal to identify valid pulses, and reject any distorted pulses in the PWM signal.

In some embodiments, the distortion-rejecting sampler 122 calculates the duty cycle of each incoming PWM signal and evaluates it against the previous duty cycle. If the sampler 122 determines that the calculated duty cycle is within a range (e.g. within +/−10%) of the previous duty cycle, which defines a window of validity, the sampler 122 identifies the new/current PWM pulse as valid and uses it to generate a new sample value at the output. If the duty cycle of the current PWM pulse falls outside of this window of validity, the sampler 122 identifies the pulse as noise and discards it. An example of the window of validity 220 with reference to a duty cycle (T(ON)/T(cycle)) of a PWM pulse 220 is illustrated in FIG. 4. In the case of a missing pulse (see, e.g., 214 in FIG. 3), the cycle duration (T(cycle)) is doubled or the duty cycle is cut by half, and the subsequent pulse ends up far short the window of validity and is discarded. In some embodiments, the sampler 122 identifies as in valid, and rejects, all missing pulses or those that are too narrow or too wide to fit within the window of validity, ensuring that these pulses will not affect the output or alter the light intensity of the light source 20. In other words, the sampler 122 uses the window of validity to qualify the pulses that may be passed onto the control signal generator 124.

Full rejection of noise may cause the power supply device to ignore all extraneous PWM pulses. This may mask any true movement of the Triac dimmer switch. Accordingly, in some embodiments, the sampler 122 utilizes two counters to track excursions outside the window of validity, which are referred to as higher and lower counts. Each time the sampler 122 identifies a PWM pulse that is too wide or too narrow to fit within the window the sampler 122 increments the higher count or the lower count, respectively. When the sampler encounters a PWM pulse within the window, it clears/resets both counts. When either the higher or lower count passes a set or predefined threshold, this indicates that the dimmer level has in fact changed (e.g., as a result of a user moving a dimmer lever), so the output of the power supply controller 120 should follow the modified input AC signal. The threshold may depend on the type of dimmer, and is selected to substantially reduce (e.g., minimize) distortions in the control signal while also allowing real changes in the dimmer level to be accurately detected and followed. In some examples, the threshold may be a value between 3 and 10 (e.g., 5), which may provide a delay of about 25-80 mS before reacting to actual changes in the dimmer level.

Figure 5:
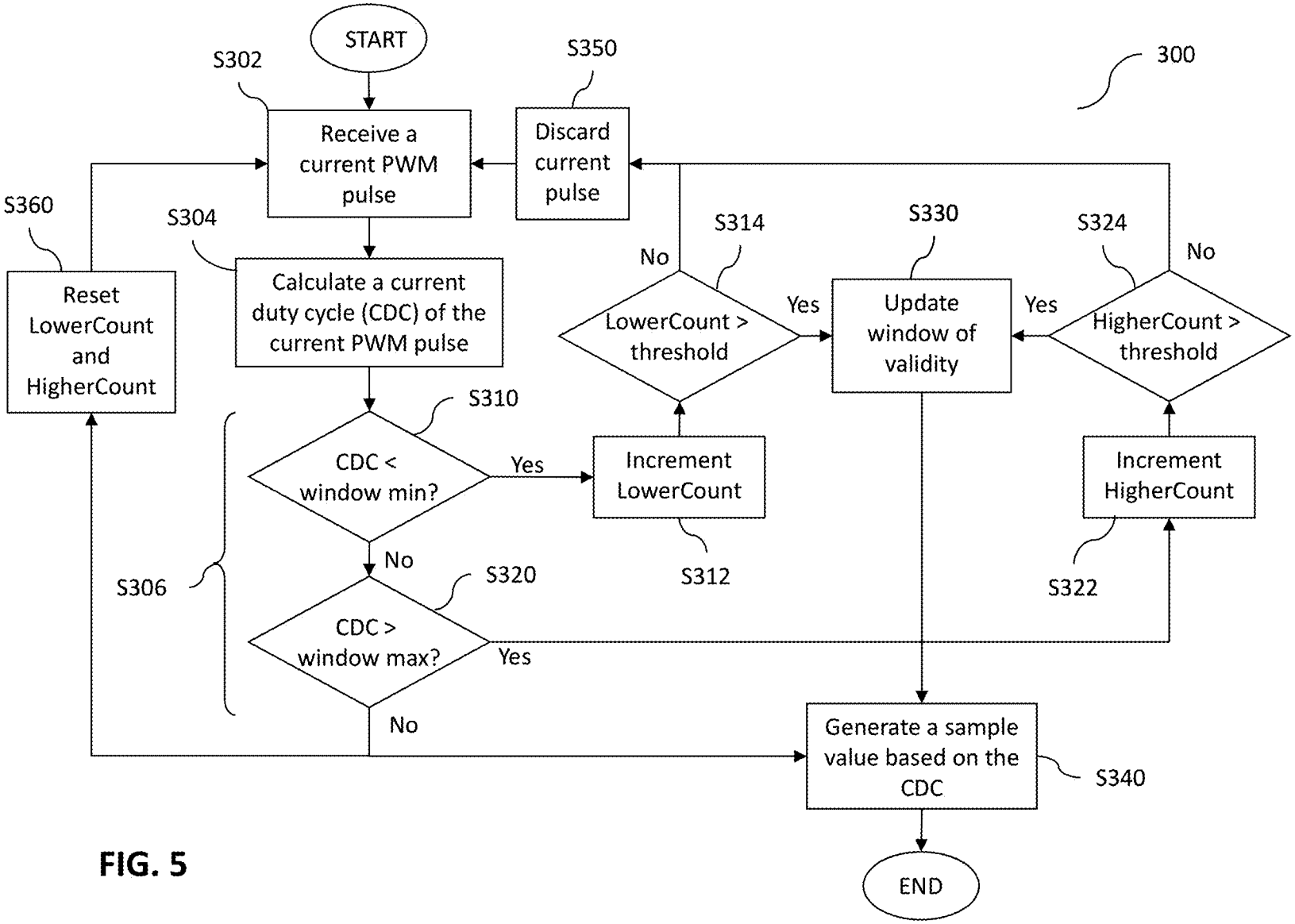
FIG. 5 is a flow diagram illustrating a process of rejecting invalid PWM pulses by the power supply controller, according to some example embodiments of the present disclosure.

FIG. 5 is a flow diagram illustrating a process 300 of rejecting invalid PWM pulses by the power supply controller 120, according to some example embodiments of the present disclosure.

Referring to FIG. 5, in some embodiments, the power supply controller 120 (e.g., the sampler 122) receives a plurality of sample values corresponding to dimmer levels of the dimmer 10 (S302), and calculates the duty cycle of the current (i.e., most recently received) PWM pulse (S304), which is henceforth referred to as the current duty cycle. In some embodiments, the power supply controller 120 compares the current duty cycle with a window of validity established based on a previous duty cycle (S306). This may include comparing the current duty cycle with at least one of the minimum duty cycle in the window of validity (S310) and the maximum duty cycle in the window of validity (S320) to determine whether the current duty cycle falls within the window of validity or not. In response to determining that the current duty cycle is not within the window of validity, the power supply controller 120 increments a count of out-of-range PWM pulses having duty cycles not within the window of validity (S312 or S322) and determines whether the count of out-of-range PWM pulses is greater than a threshold (S314 or S324). When the current duty cycle is less than a minimum duty cycle in the window of validity (S310), the power supply controller 120 increments a lower count of out-of-range PWM pulses having duty cycles not within the window of validity (S312), and compares the lower count of out-of-range PWM pulses with the threshold (S314). The threshold may be any suitable value, for example, 3, 6, 8, or the like. When the current duty cycle is greater than a maximum duty cycle in the window of validity (S320), the power supply controller 120 increments a higher count of out-of-range PWM pulses having duty cycles not within the window of validity (S322), and compares the higher count of out-of-range PWM pulses with the threshold (S324).

In response to determining that the lower/higher count of out-of-range PWM pulses is greater than the threshold, the power supply controller 120 identifies the current PWM pulse as a valid pulse and updates the window of validity based on the current duty cycle (S330). Doing so may involve calculating the minimum/maximum duty cycle as the current duty cycle minus/plus a certain negative/positive tolerance (e.g., about −5% to about +5%, or about −7% to about +7% of the current duty cycle). The power supply controller 120 then proceeds to generate a sample value corresponding to the current duty cycle for transmission to the power supply (S340).

In response to determining that the lower/higher count of out-of-range PWM pulses is less than or equal to the threshold, the power supply controller 120 identifies the current PWM pulse as an invalid pulse and discards it (S350), that is, the power supply controller 120 doesn't generate a corresponding sample value and proceeds to receive and analyze the next PWM pulse. Therefore, distorted pulses and missing pulses are rejected by the power supply controller 120 and do not affect the control signal.

When the power supply controller 120 determines that the current duty cycle is within the window of validity (S306), it identifies the current PWM pulse as valid, generates a sample value corresponding to the current duty cycle (S340), clears (e.g., resets to zero) the higher and lower counts of out-of-range PWM pulses (S360), and proceeds to receive and analyze the next PWM pulse.

According to some embodiments, the power supply controller 120 includes any combination of hardware, firmware, or software, employed to process data or digital signals. This may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In the power supply controller 120, each function may be performed either by hardware configured, i.e., hard-wired, to perform that function, or by more general purpose hardware, such as a CPU, configured to execute instructions stored in a non-transitory storage medium. The power supply controller 120 may be fabricated on a single printed wiring board (PWB) or distributed over several interconnected PWBs.

Figure 6:
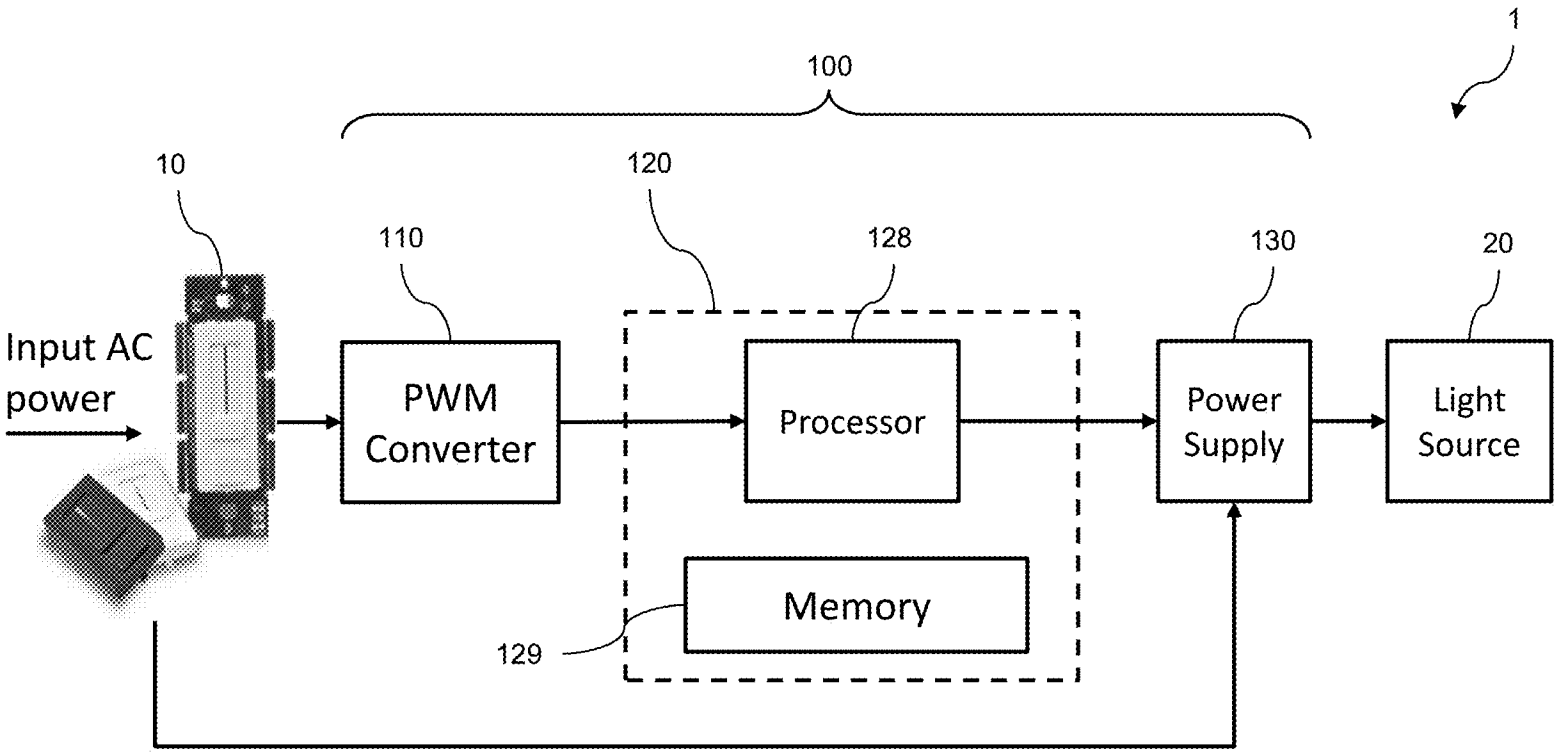
FIG. 6 illustrates the power supply controller implemented as a processor and memory, according to some embodiments of the present disclosure.

FIG. 6 illustrates the power supply controller implemented as a processor and memory, according to some embodiments of the present disclosure.

As shown in FIG. 6, in some embodiments, the power supply controller 120 includes a processor 128 and a memory 126. The processor 128 may include, for example, one or more application specific integrated circuits (ASICs), general purpose or special purpose central processing units (CPUs), digital signal processors (DSPs), graphics processing units (GPUs), and programmable logic devices such as field programmable gate arrays (FPGAs). The memory 126 may have instructions stored thereon that, when executed by the processor 128, cause the processor 128 to perform the operations of the sampler 122 and the control signal generator 124.

A described above, the distortion-rejecting power supply system, according to some embodiments of the present disclosure, monitors the PWM pulses generated from a dimmer's modified AC signal to detect and reject distorted and missing pulses, and prevents such pulses from affecting the drive signal of the power supply. As such, the light output of the light driven by the power supply is unaffected by dimmer distortions and can remain flicker-free. Accordingly, some embodiments of the present disclosure allow the power supply system to be used with a wide range of Triac dimmers that are commercially available, and give end-users the ability to retrofit using existing dimmer switches to drive LED lighting. Because, in some embodiments, the filtering process is accomplished by a microprocessor, there is no need to update hardware with filters, which reduces overall system cost.

It will be understood that, although the terms "first", "second", "third", etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include", "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of", when preceding a list of elements, modify the entire list of elements and do not modify the individual elements of the list. Further, the use of "may" when describing embodiments of the inventive concept refers to "one or more embodiments of the inventive concept". Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the terms "substantially", "about", and similar terms are used as terms of approximation and not as terms of degree, and are intended to account for the inherent variations in measured or calculated values that would be recognized by those of ordinary skill in the art.

As used herein, the terms "use", "using", and "used" may be considered synonymous with the terms "utilize", "utilizing", and "utilized", respectively.

The various components of the power supply system may be formed on one integrated circuit (IC) chip or on separate IC chips. Further, the various components of the power supply system may be implemented on a flexible printed circuit film, a tape carrier package (TCP), a printed circuit board (PCB), or formed on the same substrate. Further, the various components of the power supply system may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). Also, a person of skill in the art should recognize that the functionality of various computing devices may be combined or integrated into a single computing device, or the functionality of a particular computing device may be distributed across one or more other computing devices without departing from the scope of the exemplary embodiments of the present disclosure.

While this disclosure has been described in detail with particular references to illustrative embodiments thereof, the embodiments described herein are not intended to be exhaustive or to limit the scope of the disclosure to the exact forms disclosed. Persons skilled in the art and technology to which this disclosure pertains will appreciate that alterations and changes in the described structures and methods of assembly and operation can be practiced without meaningfully departing from the principles, spirit, and scope of this disclosure, as set forth in the following claims and equivalents thereof.

What is claimed is:

1. A method of controlling a power supply electrically coupled to a dimmer, the method comprising:

receiving a current pulse-width-modulated (PWM) pulse of a plurality of PWM pulses corresponding to a dimmer level;

calculating a current duty cycle of the current PWM pulse;

comparing the current duty cycle with a window of validity to determine whether the current duty cycle is within the window of validity; and in response to determining that the current duty cycle is not within the window of validity, determining whether a count of out-of-range PWM pulses having duty cycles not within the window of validity is greater than a threshold; and in response to determining that the count of out-of-range PWM pulses is greater than the threshold:

generating a sample value corresponding to the current duty cycle for transmission to the power supply.

2. The method of claim 1, further comprising:

receiving a modified AC input signal from the dimmer; and generating a PWM signal based on the modified AC input signal, the PWM signal comprising the plurality of PWM pulses.

3. The method of claim 1, wherein the current duty cycle of the current PWM pulse corresponds to a current dimmer level of the dimmer.

4. The method of claim 1, wherein the window of validity corresponds to a previous duty cycle associated with a previous PWM pulses of the plurality of PWM pulses.

5. The method of claim 4, wherein the window of validity comprises values within a range of the previous duty cycle.

6. The method of claim 5, wherein the range of the previous duty cycle is from a negative tolerance to a positive tolerance of the previous duty cycle.

7. The method of claim 1, further comprising, in response to determining that the current duty cycle is not within the window of validity:

incrementing the count of out-of-range PWM pulses.

8. The method of claim 1, further comprising:

in response to determining that the current duty cycle is within the window of validity, generating the sample value corresponding to the current duty cycle for transmission to the power supply.

9. The method of claim 1, further comprising, in response to determining that the count of out-of-range PWM pulses is greater than the threshold:

updating the window of validity based on the current duty cycle; and generating the sample value corresponding to the current duty cycle for transmission to the power supply.

10. The method of claim 1, further comprising:

in response to determining that the count of out-of-range PWM pulses is less than or equal to the threshold:

identifying the current PWM pulse as invalid to discard the current PWM pulse.

11. The method of claim 1, wherein the comparing the current duty cycle with the window of validity comprises:

determining that the current duty cycle is less than a minimum duty cycle in the window of validity, and wherein the method further comprises, in response to determining that the current duty cycle is not within the window of validity:

incrementing a lower count of out-of-range PWM pulses having duty cycles not within the window of validity; and setting the count of out-of-range PWM pulses as the lower count of out-of-range PWM pulses.

12. The method of claim 1, wherein the comparing the current duty cycle with the window of validity comprises:

determining that the current duty cycle is greater than a maximum duty cycle in the window of validity, and wherein the method further comprises, in response to determining that the current duty cycle is not within the window of validity:

incrementing a higher count of out-of-range PWM pulses having duty cycles not within the window of validity; and setting the count of out-of-range PWM pulses as the higher count of out-of-range PWM pulses.

13. The method of claim 1, wherein the threshold is from a value from 3 to 10.

14. The method of claim 1, further comprising:

generating a control signal based on a plurality of sample values comprising the sample value for transmission to the power supply.

15. A power supply controller coupled to a power supply, the power supply controller comprising:

a processor; and a processor memory local to the processor, wherein the processor memory has stored thereon instructions that, when executed by the processor, cause the processor to perform:

receiving a current pulse-width-modulated (PWM) pulse of a plurality of PWM pulses corresponding to a dimmer level;

calculating a current duty cycle of the current PWM pulse;

comparing the current duty cycle with a window of validity to determine whether the current duty cycle is within the window of validity; and in response to determining that the current duty cycle is not within the window of validity, determining whether a count of out-of-range PWM pulses having duty cycles not within the window of validity is greater than a threshold; and in response to determining that the count of out-of-range PWM pulses is greater than the threshold:

generating a sample value corresponding to the current duty cycle for transmission to the power supply.

16. The power supply controller of claim 15, wherein the instructions, when executed by the processor, further cause the processor to perform, in response to determining that the count of out-of-range PWM pulses is greater than the threshold:

updating the window of validity based on the current duty cycle; and generating the sample value corresponding to the current duty cycle for transmission to the power supply.

17. A power supply system coupled to a dimmer and a light source, the power supply system comprising:

a pulse-width-modulated (PWM) converter configured to receive a modified AC input signal from the dimmer, and to generate a PWM signal based on the modified AC input signal, the PWM signal comprising a plurality of PWM pulses; and a power supply controller is configured to perform:

receiving a current PWM pulse of the plurality of PWM pulses corresponding to a dimmer level;

calculating a current duty cycle of the current PWM pulse;

comparing the current duty cycle with a window of validity to determine whether the current duty cycle is within the window of validity; and in response to determining that the current duty cycle is not within the window of validity, determining whether a count of out-of-range PWM pulses having duty cycles not within the window of validity is greater than a threshold; and in response to determining that the count of out-of-range PWM pulses is greater than the threshold:

generating a sample value corresponding to the current duty cycle.

18. The power supply system of claim 17, wherein the power supply controller is further configured to generate a control signal based on a plurality of sample values comprising the sample value.

19. The power supply system of claim 18, further comprising:

a power supply configured to drive the light source based on the control signal.

20. The power supply system of claim 17, wherein the current duty cycle of the current PWM pulse corresponds to a current dimmer level of the dimmer.

* * * * *